US012710217B2

(12) United States Patent
Real et al.

(10) Patent No.: US 12,710,217 B2
(45) Date of Patent: Aug. 18, 2026

(54) HEAT PUMP WITH DRAINAGE FOR LOW AMBIENT TEMPERATURE CONDITIONS

(71) Applicant: Rheem Manufacturing Company, Atlanta, GA (US)

(72) Inventors: Marcus Real, San Antonio, TX (US); Alfredo Ojeda, San Antonio, TX (US); Geethu Vasudevan, Sugar Land, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 198 days.

(21) Appl. No.: 18/453,632

(22) Filed: Aug. 22, 2023

(65) Prior Publication Data

US 2024/0068736 A1 Feb. 29, 2024

Related U.S. Application Data

(60) Provisional application No. 63/373,670, filed on Aug. 26, 2022.

(51) Int. Cl.
*F25D 21/14* (2006.01)
*F25B 30/00* (2006.01)

(52) U.S. Cl.
CPC ..... *F25D 21/14* (2013.01); *F25B 30/00* (2013.01); *F25D 2321/144* (2013.01)

(58) Field of Classification Search
CPC ..... F25D 21/14; F25D 2321/144–2321/146; F24F 1/36; F24F 1/42; F25B 30/00
See application file for complete search history.

(56) References Cited

U.S. PATENT DOCUMENTS 2,777,303 A * 1/1957 Slattery ..... F24F 13/22 236/93 R
4,382,369 A * 5/1983 Stocking ..... F25B 39/04 62/305
2016/0327331 A1* 11/2016 Forrest ..... F25B 39/00

FOREIGN PATENT DOCUMENTS

CN 109140744 A * 1/2019 ..... F24F 13/222

OTHER PUBLICATIONS

English language translation of CN109140744 to Chen et al. Translated May 2025 (Year: 2019).*

* cited by examiner

*Primary Examiner* — Cassey D Bauer
(74) *Attorney, Agent, or Firm* — Eversheds Sutherland (US) LLP

(57) ABSTRACT

Heat pumps are often desired to be used over other types of HVAC units given their efficiency. In some cases, this efficiency may be further improved by using condensate that is naturally produced by an indoor coil of the heat pump when in a cooling mode. For example, any accumulate condensate may be "thrown" onto any components of the heat pump using a "slinger ring" attached to a fan inside the unit. However, this condensate accumulation may be problematic in a heating mode of the heat pump because the water may freeze and prevent the fan and/or corresponding motor from properly functioning. Thus, the systems and methods provided herein present a heat pump including a multi-layered basepan including an outdoor coil tray that allows condensate to be routed to the drain platform underneath the unit while limiting the ability of condensate to reach the slinger ring in the heating mode.

18 Claims, 14 Drawing Sheets

HEAT PUMP WITH DRAINAGE FOR LOW AMBIENT TEMPERATURE CONDITIONS

CROSS-REFERENCE TO RELATED APPLICATION(S)

This application claims priority to and the benefit of U.S. Provisional Application No. 63/373,670, filed on Aug. 26, 2022, the disclosure of which is hereby incorporated herein by reference in its entirety.

FIELD

This application relates generally to heat pumps, and more particularly to heat pumps with drainage for low ambient temperature conditions.

BACKGROUND

A heat pump is a type of heating, ventilation, and air conditioning (HVAC) unit that serves as a more efficient alternative to a traditional gas or electric unit. This increased efficiency results from the heat pump working to transfer heat, rather than burning fuel to generate the heat. Heat pumps may also exist in the form of a single unit, rather than requiring separate installations for heating units and cooling units.

Heat pumps may be provided in a number of different physical packages. For example, a package terminal air conditioner (PTAC) and a vertical packaged air conditioner (VPAC) are types of self-contained heating and air conditioning systems commonly found in hotels or motels. Most PTAC and VPAC units are designed to go through a wall having vents and/or heat sinks both inside and outside. These units may include a plenum used to bring outdoor air into a lower compartment including an outdoor coil and exhausted to the outdoors. This air is ducted to the indoor room and provides cooling or heating to the indoor side. While PTACs and VPACs are commonly used to heat or cool a single living space, there are cooling-only PTACs and/or VPACs with an external heating source.

Given that heat pumps exist as a single unit, they operate in multiple different modes to generate heating or cooling for a building's interior. In the summer months, the heat pump works in a cooling mode similar to a standard air conditioner. A refrigerant is used to absorb heat from the building interior and transfer the heat to the outdoor environment. This is accomplished by adjusting the pressure of the refrigerant. At low pressures, the refrigerant may absorb heat from the air and evaporate from a liquid to a gas. At high pressures, the gas refrigerant is at a higher energy level than the outside air, so heat is exchanged between the gas refrigerant and the surrounding air, and the refrigerant condenses back to a liquid state. By controlling the pressure of the refrigerant, an air conditioner can extract heat from the building's interior.

In this cooling mode, an indoor coil included in the unit produces condensate, which eventually makes its way down to the outdoor section of the unit. Given that these units may be single package vertical units, this condensate that is produced may be used to increase the efficiency of the unit. This may be accomplished by using a component called a "slinger ring" (which may be located on an outdoor coil fan of the unit) to pick up the water and "throw" the water against the hot outdoor coil that serves as the condenser while in the cooling mode. In this manner, the resulting water that is naturally produced by this process may be used as a further cooling mechanism for the outdoor coil of the unit.

A heat pump uses the reverse process in the winter months to extract heat from the outside environment and transfer it into the building interior. Even when the outdoor environment is cold, there is still some amount of heat in the outdoor air. Given that the outdoor air has greater energy levels than the cold, low-pressure refrigerant, the refrigerant absorbs that heat and evaporates. As in the cooling mode, the gas refrigerant in the heating mode may be pressurized, which raises the temperature. When the refrigerant is piped back into the building interior, it is used to warm the inside air, until the heat is extracted and condenses back into a liquid, and the cycle continues.

That is, in the heating mode the operation of the unit is reversed, so the outdoor coil produces the condensate. This may be problematic because the heating mode is typically used when the ambient temperature of the outside environment is relatively low. This may result in the water freezing within the unit before the water is able to drain from the unit. The frozen water levels within the unit may accumulate to a level at which the outdoor coil fan is physically blocked from rotating and the motor driving the fan is unable to operate. This illustrates a downside of standard heat pumps, which are much more efficient than electric heating units that use resistive heaters, but may have difficulty operating in colder environments (for example, below 35-40 degrees Fahrenheit).

BRIEF DESCRIPTION OF THE DRAWINGS

The detailed description is set forth with reference to the accompanying drawings. In some instances, the use of the same reference numerals may indicate similar or identical items. Various embodiments may utilize elements and/or components other than those illustrated in the drawings, and some elements and/or components may not be present in various embodiments. Throughout this disclosure, depending on the context, singular and plural terminology may be used interchangeably.

DETAILED DESCRIPTION

Figure 1:
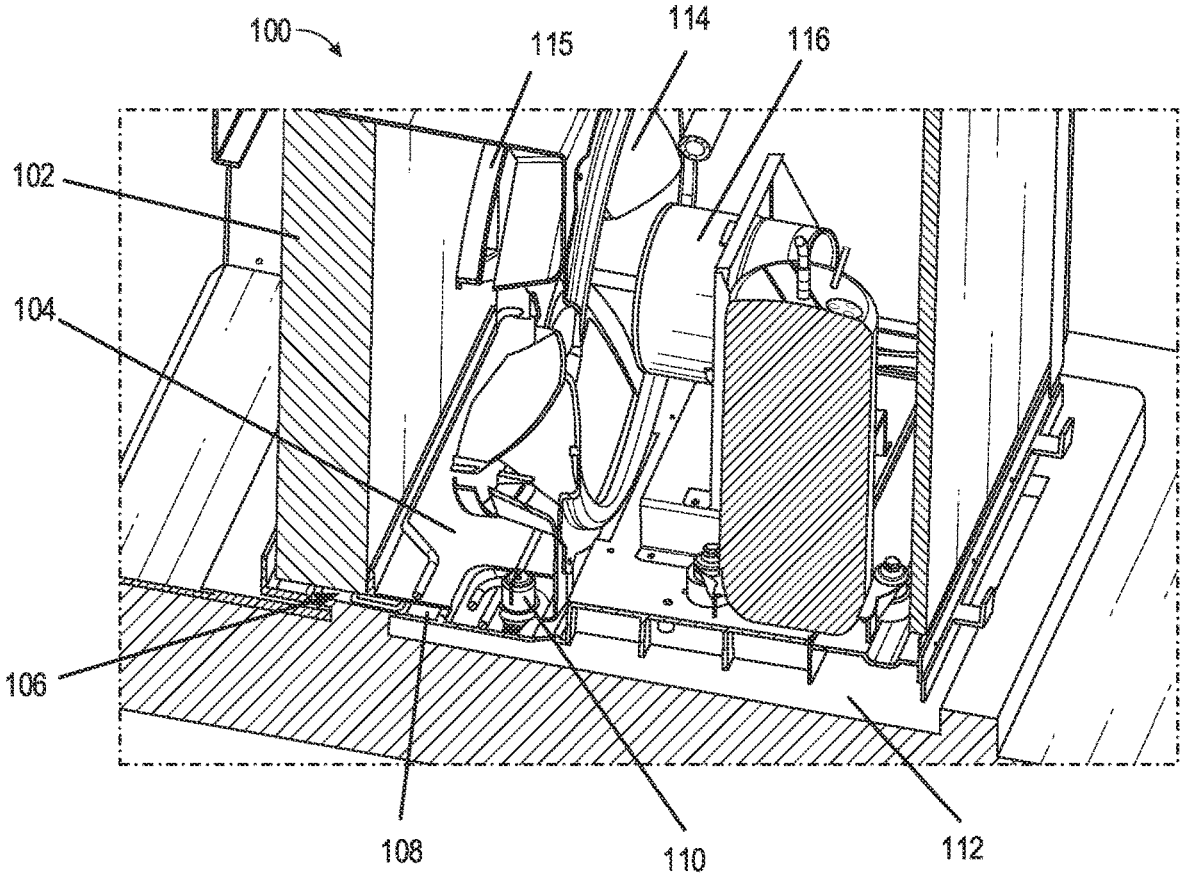
FIG. 1 illustrates a perspective cross-sectional view of a single package vertical unit in accordance with one or more embodiments of the present disclosure.

The systems and methods disclosed herein describe a heat pump with drainage for low ambient temperature conditions. That is, the heat pump as described herein is configured in such a way as to allow for usage in lower ambient temperature conditions. Traditional heat pumps may include a temperature-actuated condensate drain valve, which senses ambient temperatures and automatically actuates when the temperature reaches or drops below a threshold temperature. This allows condensate produced by the evaporator to be drained from the unit when operating in a heating mode. However, even with such a drain valve, the heat pump may still experience frozen water buildup because some or all of the condensate is not able to reach the drain valve before freezing. This may result in the heat pump being effectively inoperable in low ambient temperature conditions as frozen condensate accumulates, which may eventually prevent components within the unit from operating effectively or at all.

In contrast, the heat pump described herein may improve upon current heat pumps in a number of aspects, such as by introducing a multi-layered condensate draining section in the basepan of the unit that includes an outdoor coil tray that is positioned above a lower drain pan. This separate outdoor coil tray serves to separate the outdoor coil and the lower drain pan from the front section of the unit that includes the slinger ring (this multi-layered configuration is illustrated in more detail in at least FIGS. 1-3). The outdoor coil tray reduces the potential for condensate produced by the outdoor coil in heating mode from reaching the slinger ring and freezing. Instead, the water is directed towards the drain pan of the unit. This configuration allows for condensate produced by the unit to be used to increase efficiency in cooling mode, while also mitigating or preventing potential downsides that may arise from the water existing in the unit in the heating mode.

The heat pump configuration described herein is particularly beneficial because it allows for the more efficient heat pump to be used in low ambient conditions, whereas a standard gas or electric unit may need to be used in place of the traditional heat pump in such conditions. In some cases, a heat pump may be up to 75% more efficient than a traditional gas or electric heating unit, so it is desirable to maintain usage of the heat pump in all conditions.

The heat pump configuration is also beneficial for reducing the buildup of algae and other contaminants within the unit. This is because the basepan draining provided in the heat pump may prevent water from sitting within the unit for extended periods of time while the unit is not in use.

While reference is made herein to a single package vertical unit, these same systems and methods may be applicable to any other type of heating air and ventilation (HVAC) systems as well, for example, window air conditioners, PTACs, etc.

Turning now to the drawings, an example heat pump system and method of operating the heat pump in low ambient temperature conditions in accordance with aspects of the present disclosure will now be described in greater detail with reference to FIGS. 1-9.

FIG. 1 illustrates a perspective cross-sectional view of a single package vertical unit 100 (for example, a heat pump) in accordance with one or more embodiments of the present disclosure.

Figure 9A:
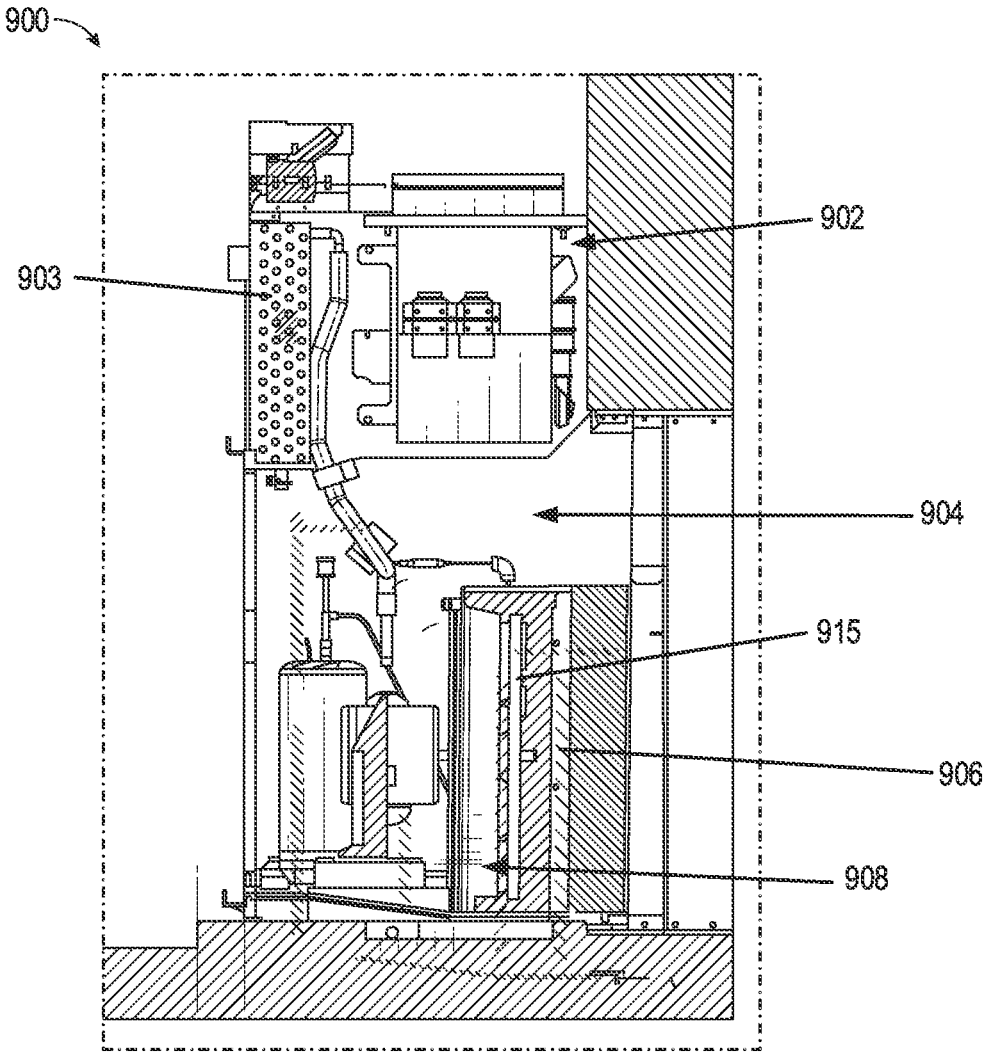
FIG. 9A illustrates another cross-sectional view of the single package vertical unit of FIG. 1 in accordance with one or more embodiments of the present disclosure.

Particularly, the perspective cross-sectional view shown in the figure focuses on a section of the single package vertical unit 100 including the outdoor coil 102 (for example, outdoor heat exchanger section 904 of FIG. 9A). The figure also shows an outdoor coil fan 114 and a motor 116 that is used to operate the outdoor coil fan 114. The motor 116 may drive the outdoor coil fan 114, which may be used to move air across the outdoor coil. For example, in the cooling mode, the outdoor coil fan 114 may move air across the outdoor coil 102 acting as the condenser in the single package vertical unit 100 in order to cool the outdoor coil 102. The outdoor coil fan 114 may also operate in the heating mode to draw outside air across the outdoor coil 102 where the refrigerant in the outdoor coil 102 absorbs heat through evaporation.

Affixed to the outdoor coil fan 114 may be a slinger ring 115. As one non-limiting example, the slinger ring may be removably or permanently affixed around the outer edge portions of the fan blades of the outdoor coil fan 114. However, the slinger ring 115 may also be configured in any other form and may be attached to the outdoor coil fan 114 in any other manner as well.

As the outdoor coil fan 114 rotates based on a rotation of a shaft of the motor 116, the slinger fan 115 may also rotate along with the rotation of outdoor coil fan 114. The purpose of this slinger ring 115 is to "pick up" any condensate that is accumulated at the bottom of the single package vertical unit 100 and "throw" the condensate within the single package vertical unit 100. That is, the water may be aggregated and redirected to other portions of the single package vertical unit 100. This effectively provides additional water cooling for components (for example, the outdoor coil 102) included within the single package vertical unit 100 during a cooling mode of operation.

The single package vertical unit 100 may also include a lower drain pan 108 and an outdoor coil tray 104 separating the outdoor coil 102 from the lower drain pan 108. The single package vertical unit 100 may sit on a drain platform 112 which may provide access to building drainage (not shown in the figure). The single package vertical unit 100 may also include any other components not shown in this figure, such as an indoor coil, etc. More comprehensive views of the single package vertical unit 100 may be shown in FIGS. 9A-9C, for example.

During a heating mode (for example, when the single package vertical unit 100 operates to provide warm air to a building), the outdoor coil 102 serves as an evaporator and an indoor coil (not shown in the figure) serves as a condenser. In this mode, the outdoor coil 102 produces condensate (which may also be interchangeably referred to as "water" herein) that has the potential to accumulate and freeze given the low ambient temperatures in which the heating mode is used. If the frozen water accumulation is too substantial, then the frozen water may reach the outdoor coil fan 114 and/or the motor 116 and prevent them from properly functioning. In a typical single package vertical unit, there may only exist the lower drain pan 110 and a temperature-actuated drain valve 114. The purpose of the temperature-actuated drain valve 114 may be to allow any condensate produced by the outdoor coil 102 to be drained to the drain platform 112 on which the single package vertical unit 100 sits. However, as aforementioned, these drain valves on their own may not necessarily sufficiently prevent frozen water accumulation because the water may not be able to reach the drain valve before the water freezes.

In contrast with this typical single package vertical unit configuration, to mitigate or prevent accumulation of freezing water within the single package vertical unit 100 while in the heating mode, the outdoor coil tray 104 may direct any condensate produced by the outdoor coil 102 directly to the lower drain pan 108 and to the drain platform 112 while also serving as a physical divider between the lower drain pan 108 and the components located in the indoor heat exchanger section of the single package vertical unit 100, such as the outdoor coil fan 114, the motor 116, and the slinger ring 115. This may reduce the potential of the condensate reaching the outdoor coil fan 114, the motor 116, and the slinger ring 115 in the heating mode of operation. The outdoor coil tray 104 may include one or more perforated plates 106 underneath the outdoor coil 102, which may allow for the condensate to travel through the outdoor coil tray 104 and to the lower drain pan 108. The one or more perforated plates 106 are illustrated further in FIG. 3.

After traveling through the one or more perforated plates 106 to the lower drain pan 108, the condensate may travel across the lower drain pan 108 to a drain hole (not shown in the figure), which provides access to the drain platform 112. The lower drain pan 108 may be sloped towards the drain hole to direct the condensate more quickly towards the drain hole. Additionally, the lower drain pan 108 may include one or more resistive heating elements (not shown in the figure), which may assist in preventing the condensate from freezing while traveling through the lower drain pan 108. For example, these may be metallic coils (or other elements) through which current may be run. This may, in turn, cause the resistive heating elements to produce heat that may be used to prevent the condensate from freezing. However, the resistive heating elements may be provided in any other form and may prevent the condensate from freezing in any other manner.

The temperature-actuated drain valve 110 may be positioned over the drain hole in the lower drain pan 108. The temperature-actuated drain valve 110 may be configured to actuate a plunger (or any other type of physical element that may be used to cover the drain hole) that may either cover or uncover the drain hole depending on the actuation of the temperature-actuated drain valve 110. The actuation may be triggered based on a threshold temperature value (the threshold temperature value may be based on an ambient temperature or any other temperature value) being satisfied. That is, the temperature-actuated drain valve 110 may be configured to actuate to a first positon when a temperature is determined to be less than or equal to a threshold temperature to uncover the drain hole and allow condensate to flow through the lower drain pan 108 and to the drain platform 112. For example, this threshold temperature may be associated with the single package vertical unit 100 operating in the heating mode. However, the threshold temperature may include any other temperature as well. When the temperature is greater than or equal to the threshold temperature, then the temperature-actuated drain valve 110 may actuate to a second position in which the drain hole is covered and condensate is allowed to build up to a level at which the slinger ring is able to come into contact with the water. Effectively, this allows the condensate to still be accumulated and used by the slinger ring to cool the outdoor coil 102 during the cooling mode, but also allows the condensate to be quickly drained to the drain platform 112 during the heating mode to prevent buildup of freezing water.

The temperature-actuated drain valve 110 may also be actuated based on factors other than temperature as well. For example, to prevent condensate from sitting within the single package vertical unit 100 for extended periods of time while the single package vertical unit 100 is not in operation, the temperature-actuated drain valve 110 may be actuated when the unit is not in operation to allow the condensate to drain from the unit. This may mitigate or prevent the build-up of algae or other types of contaminants within the single package vertical unit 100 that may result from water sitting within the unit. For example, the drain valve 100 may also be a solenoid-type drain valve that may be electrically driven using a control relay. This may allow for controlled operation in off-cycles. Additionally, a sail switch (or other airflow dependent switch) may be used to operate the drain valve 110 when the outdoor motor 116 and outdoor coil fan 114 are not operating.

Figure 2A:
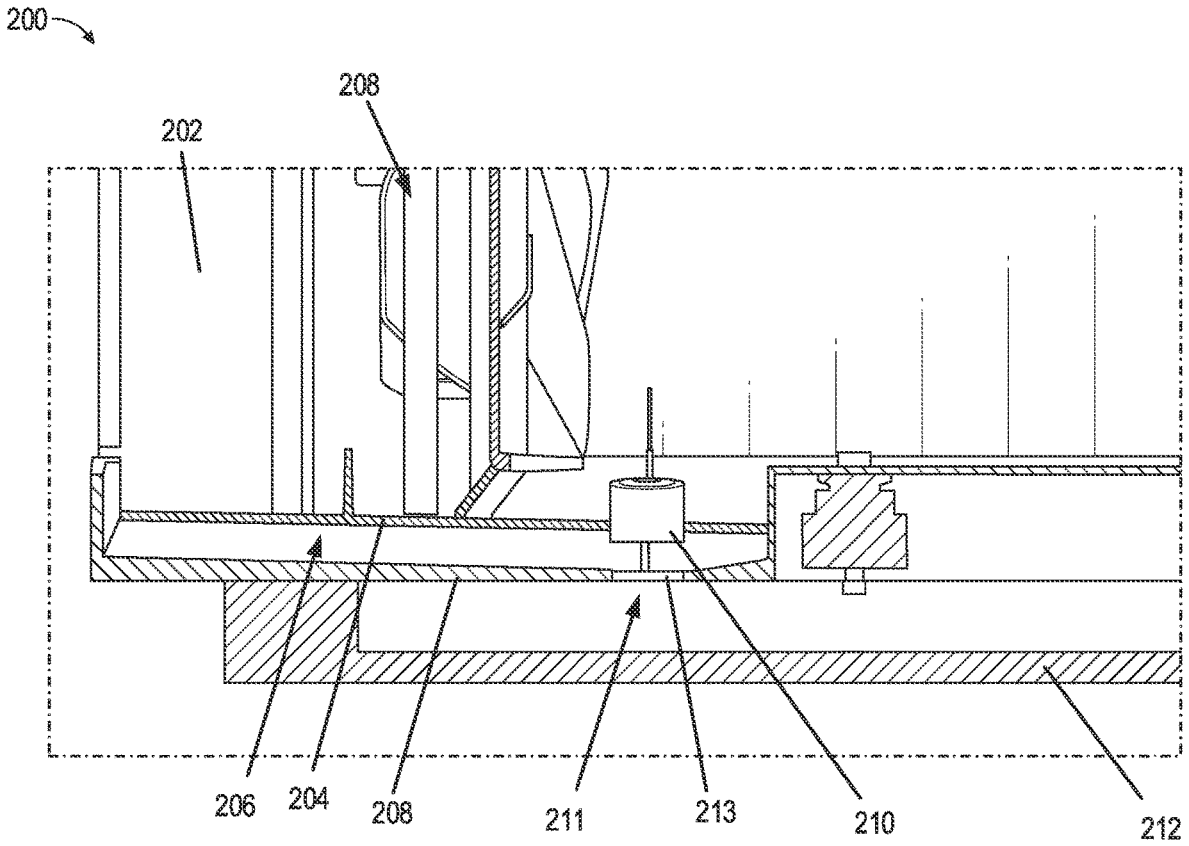
FIGS. 2A-2B illustrate another cross-sectional view of the single package vertical unit of FIG. 1 in accordance with one or more embodiments of the present disclosure.
Figure 2B:
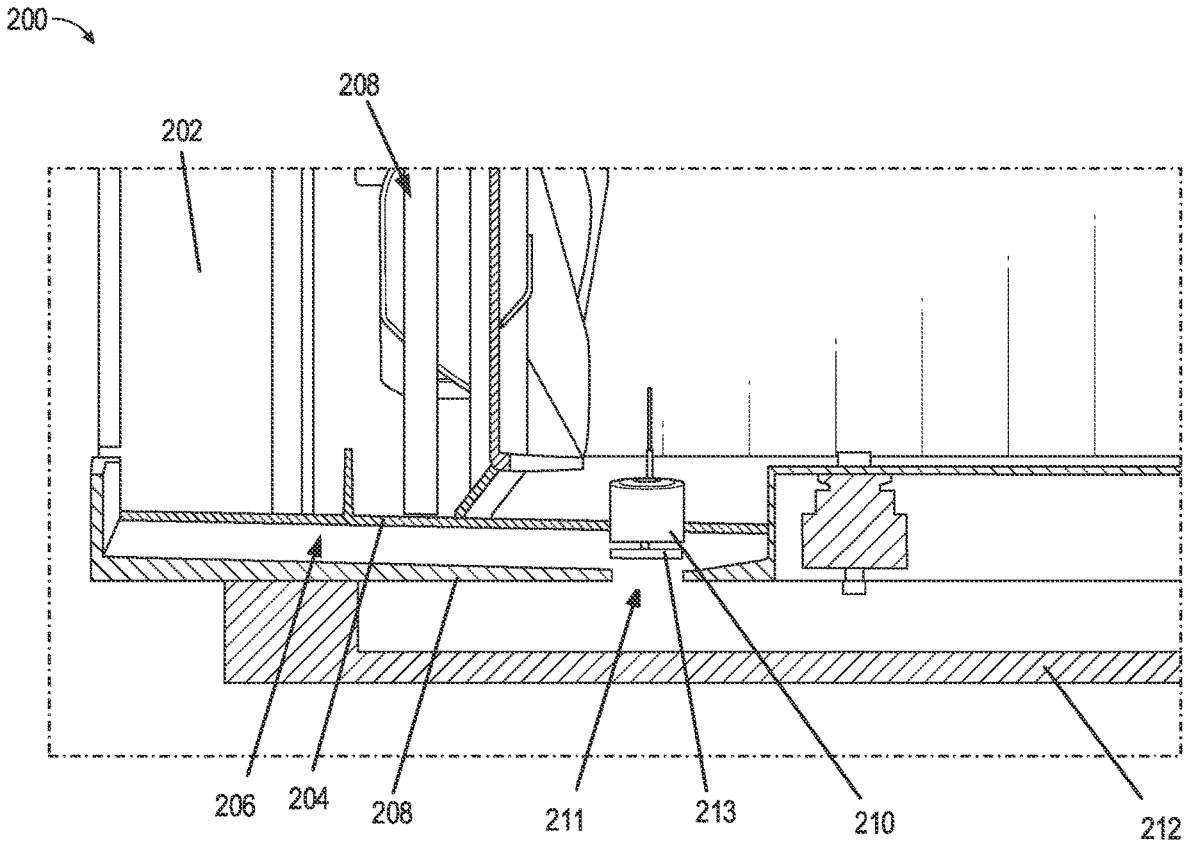

FIGS. 2A-2B illustrate another cross-sectional view of the single package vertical unit 200 (which may be the same as, or similar to, the single package vertical unit 100 of FIG. 1 or any other single package vertical unit) in accordance with one or more embodiments of the present disclosure. The cross-sectional views of FIGS. 2A-2B further illustrate the position of the outdoor coil tray 204 relative to the lower drain pan 208, as well as the actuation of the temperature-actuated drain valve 210 relative to the drain hole 211. Particularly, FIG. 2A illustrates the temperature-actuated drain valve 210 in a position in which the drain hole is covered and FIG. 2B illustrates the temperature-actuated drain valve 210 in a position in which the drain hole is uncovered. Any of the components illustrated in FIG. 2 may be the same as or similar to like components illustrated in FIG. 1 (or any other figure).

Beginning with FIG. 2A, the temperature-actuated drain valve 210 is shown as being actuated in a position in which the drain hole 211 of the lower drain pan 208 is covered. The temperature-actuated drain valve 210 is actuated to this position when a threshold temperature is satisfied (for example, when a temperature is determined to be greater than or equal to a threshold temperature). When the temperature-actuated drain valve 210 is actuated to this position, condensate produced by the outdoor coil 202 may accumulate within the space between the lower drain pan 208 and the outdoor coil tray 204, and may eventually begin accumulating in the space above the outdoor coil tray 204 as the water level rises. When the height of the water accumulation is high enough, the slinger ring may then be able to reach the condensate and throw the condensate against other components for cooling purposes in the cooling mode.

To facilitate the covering of the drain hole 211, the temperature-actuated drain valve 210 may include a plunger 213 that may physically occupy the drain hole 211 and seal the drain hole 211 while the temperature-actuated drain valve 210 is actuated to the position. Although the plunger 213 is illustrated as being actuated into the drain hole 211, the drain hole 211 may also be covered in any other manner.

For example, the plunger 213 may instead cover a top of the drain hole 211, rather than occupying the entire drain hole 211. Additionally, the use of the plunger 213 is not intended to be limiting and the drain hole 211 may also be covered through any other type of physical element that is actuated using the temperature-actuated drain valve 210.

Turning to FIG. 2B, the temperature-actuated drain valve 210 is shown as being actuated in another position in which the drain hole 211 of the lower drain pan 208 is uncovered. The temperature-actuated drain valve 210 is actuated to this position when the threshold temperature is not satisfied (for example, when a temperature is determined to be less than or equal to the threshold temperature). When the temperature-actuated drain valve 210 is actuated in this position, condensate produced by the outdoor coil 202 drains through the drain hole 211 and into the drain platform 212. The drain platform 212 then routes the condensate outside of the building.

Figure 3:
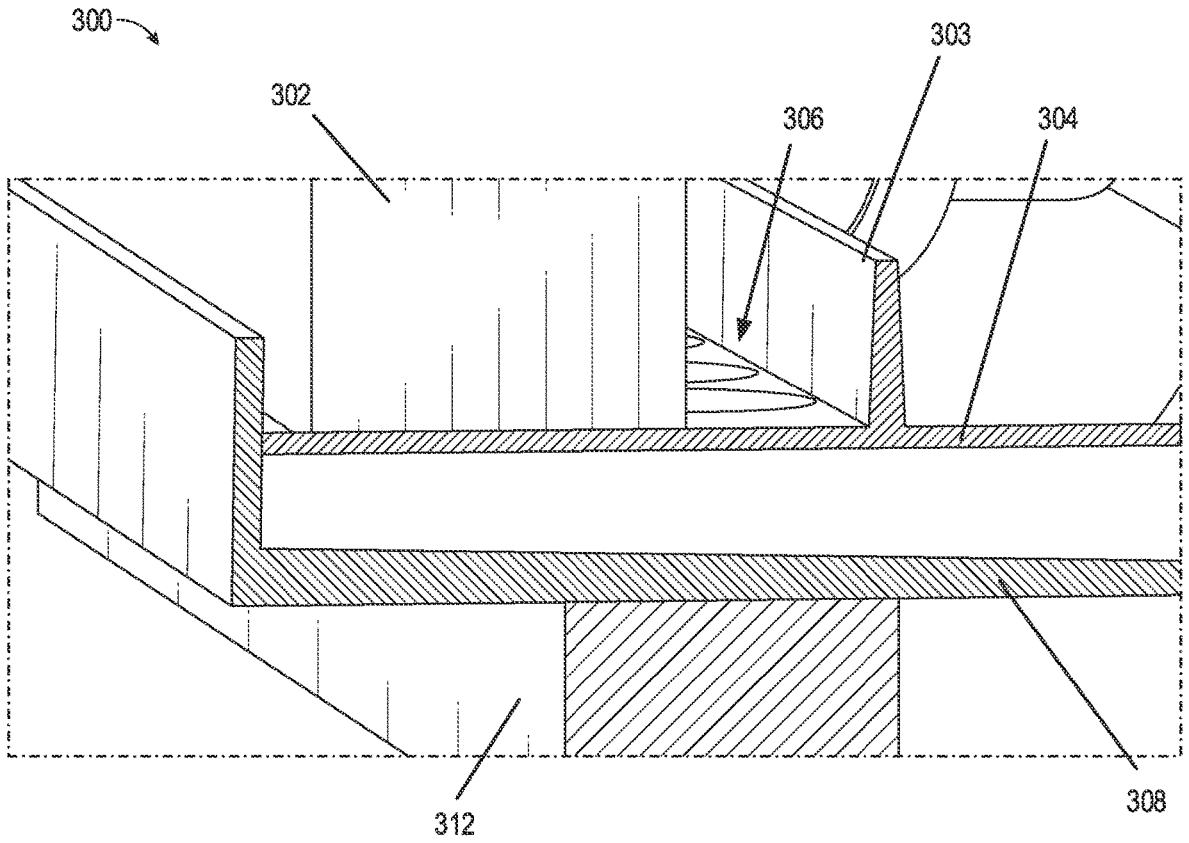
FIG. 3 illustrates a perspective cross-sectional view of a perforated plate of the single package vertical unit of FIG. 1 in accordance with one or more embodiments of the present disclosure.

FIG. 3 illustrates a perspective cross-sectional view of the perforated holes 306 of the single package vertical unit 300 (which may be the same as, or similar to, the single package vertical unit 100 of FIG. 1 or any other single package vertical unit) in accordance with one or more embodiments of the present disclosure. Any of the components illustrated in FIG. 3 may be the same as or similar to like components illustrated in FIG. 1 (or any other figure).

As shown in the figure, the outdoor coil tray 304 is positioned below the outdoor coil 302 and includes at least one sidewall 303 (which may also be referred to as a "dividing wall" herein) and one or more perforated holes 306. The combination of the sidewall 303 and the one or more perforated holes 306 may serve to direct any condensate produced by the outdoor coil 302 in a heating mode (for example, when the outdoor coil 302 acts as the evaporator in the single package vertical unit 300) directly to the lower drain pan 308, and ultimately, to the drain platform 312 on which the single package vertical unit 300 sits. The one or more perforated holes 306 shown in the figure are just one example of a configuration of the one or more perforated holes 306. That is, the one or more perforated holes 306 may also be any other combination of different sizes and/or shapes and may be positioned at any location on the outdoor coil tray 304.

Given that the outdoor coil tray 304 is positioned above the lower drain pan 308 to which the condensate is directed, the outdoor coil tray 304 may serve to at least partially separate or "wall off" the condensate from reaching the outdoor coil fan and the slinger ring. However, the outdoor coil tray 304 may not entirely prevent the condensate from being accessed by the slinger ring (not shown in the figure), as it is still desirable for the slinger ring to be able to contact the condensate to use for cooling purposes in a cooling mode of the single package vertical unit 300 (this is illustrated further in FIG. 4).

Figure 4:
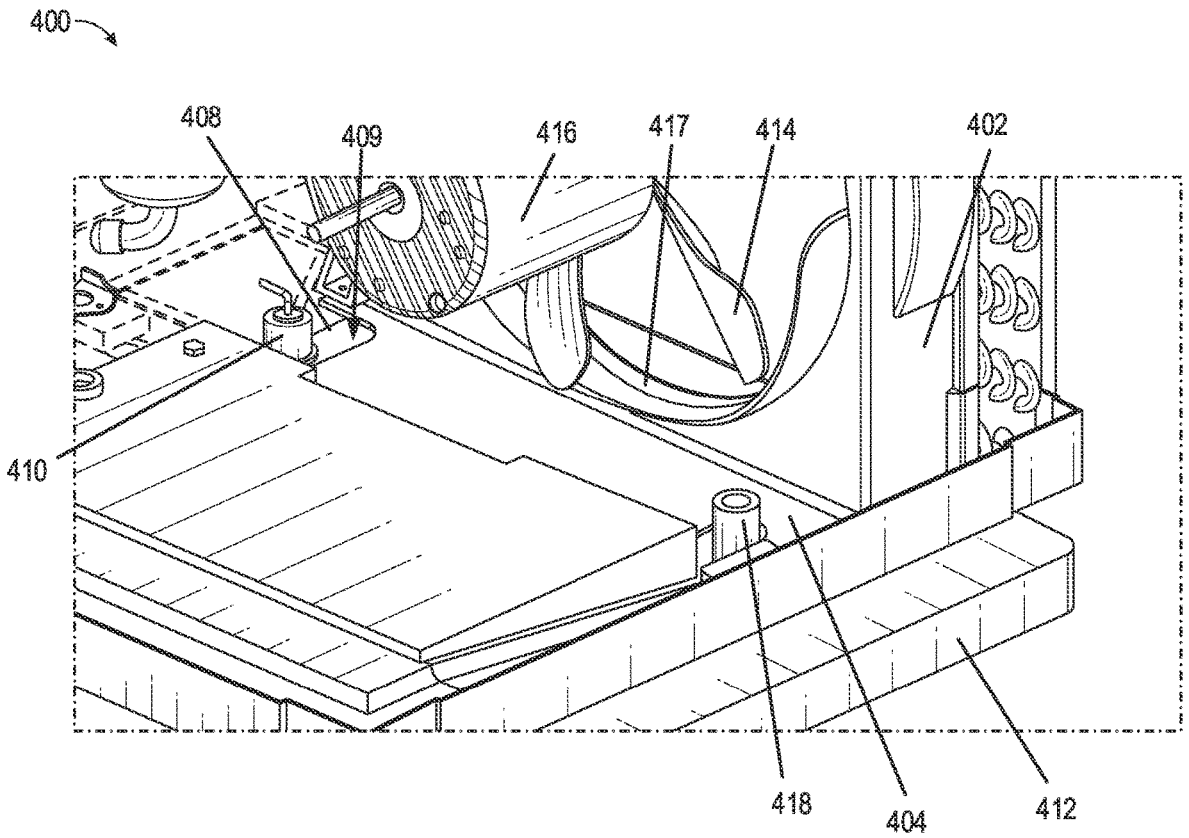
FIG. 4 illustrates another perspective cross-sectional view of the single package vertical unit of FIG. 1 in accordance with one or more embodiments of the present disclosure.

FIG. 4 illustrates another perspective cross-sectional view of a single package vertical unit 400 (which may be the same as, or similar to, the single package vertical unit 100 of FIG. 1 or any other single package vertical unit) in accordance with one or more embodiments of the present disclosure. The figure shows the outdoor coil 402, the outdoor coil fan 414, the motor 416, the slinger ring 417, the lower drain pan 408, the outdoor coil tray 404, the drain platform 412, and the temperature actuated drain valve 410. Any of the components illustrated in FIG. 4 may be the same as or similar to like components illustrated in FIG. 1 (or any other figure).

The figure also shows a stand pipe 418, which may not be visible in the perspective presented in FIG. 1. The stand pipe 418 may serve as the primary drain for the outdoor coil tray 404 and/or the lower drain pan 408 in the cooling mode. The stand pipe 418 allows for accumulation of water (for example, condensate from the outdoor coil) up to an opening of the stand pipe 418. In this manner, enough water accumulation may be provided so the slinger ring 417 is able to come into contact with and "throw" the water against the outdoor coil and/or any other components within the single package vertical unit 400, while also preventing water accumulation beyond a threshold level (by draining water above this level through the stand pipe 418).

Although the figure illustrates only one stand pipe 418 located in a particular position within the single package vertical unit 400, this is not intended to be limiting. For example, in some configurations multiple stand pipes 418 may be incorporated, which may allow for faster draining of water above the threshold water level within the single package vertical unit 400. Additionally, any of the stand pipes 418 may be positioned at any other position within the single package vertical unit 400 than the position illustrated in the figure. Further, any other type of drainage element may be used instead of a pipe as well.

In addition to showing the stand pipe 418, the figure also further illustrates how the outdoor coil tray 404 is configured to allow for water accumulation to be possible within the cooling mode. That is, the outdoor coil tray 404 may include an opening 409 proximate to the temperature-actuated drain valve 410. When the temperature-actuated drain valve 410 is actuated such that the drain hole is uncovered, the water may drain through the drain hole and not accumulate through the opening 409. However, when the temperature-actuated drain valve 410 is actuated such that the drain hole is covered, the water may be able to accumulate within the lower drain pan 408 and eventually above the outdoor coil tray 404 through the opening 409.

The illustrated configuration of the opening 409 is also not intended to be limiting. For example, the outdoor coil tray 404 may be configured in any other manner so as to allow condensate to accumulate on top of the outdoor coil tray 404 in the cooling mode.

Figure 5:
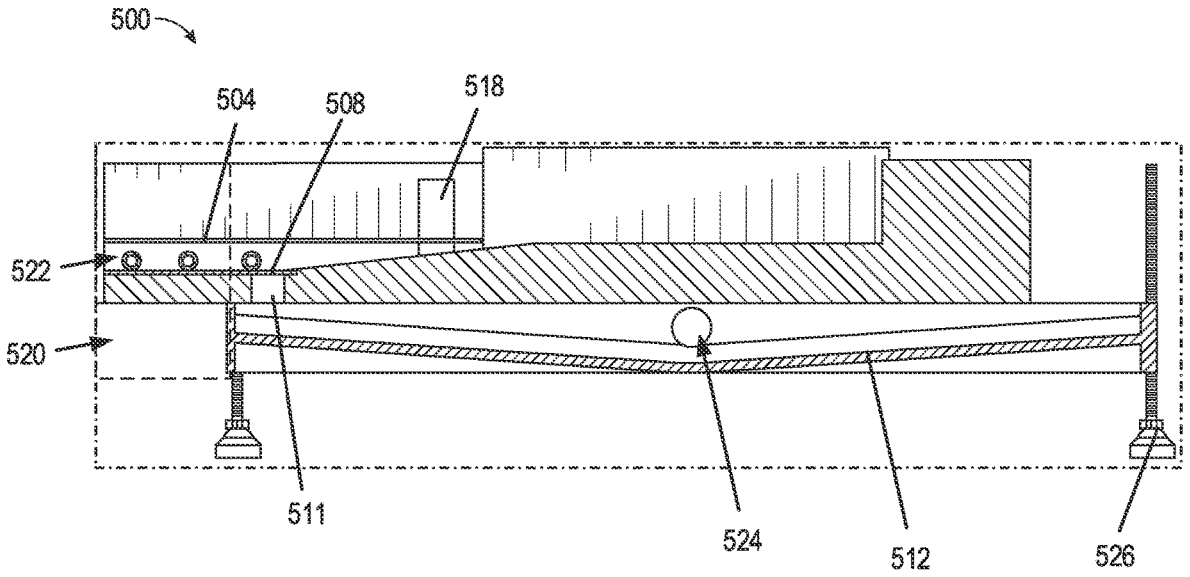
FIG. 5 illustrates a cross-sectional view of a basepan of the single package vertical unit of FIG. 1 in accordance with one or more embodiments of the present disclosure.

FIG. 5 illustrates a cross-sectional view of a basepan 500 of a single package vertical unit (which may be the same as, or similar to, the single package vertical unit 100 of FIG. 1 or any other single package vertical unit) in accordance with one or more embodiments of the present disclosure. Any of the components illustrated in FIG. 5 may be the same as or similar to like components illustrated in FIG. 1 (or any other figure).

Particularly, the figure shows that the basepan 500 sits on a drain platform 512, which may be supported from a ground surface by one or more adjustable legs 526. The drain platform 512 may be sloped downwards towards a drain port 524. The drain port 524 may allow any water to be drained out of the drain platform 512 and into the outdoor environment. The figure also shows the location of the plenum 520 of the single package vertical unit.

Within the basepan 500, the outdoor coil tray 504 is shown as being positioned above the lower drain pan 508. The lower drain pan 508 may include a drain hole 511, which may be positioned proximate to the outdoor coil to allow for optimal drainage of condensate produced by the outdoor coil when it acts as the evaporator in the heating mode. The drain hole may, for example, be a bellows or a condensate solenoid valve. The condensate solenoid valve may tie into a bi-metal switch on the outdoor coil that may open when a temperature of the outdoor coil is equal to or less than threshold temperature (for example, 80 degrees Fahrenheit or any other temperature), which may allow for draining during off cycle and in heating mode).

The figure also illustrates that the lower drain pan 508 may include one or more tubular basepan heaters 522. The tubular basepan heaters may be elements that generate heat to reduce the ability of any condensate produced by the outdoor coil from freezing before reaching the drain hole 511. Finally, the figure also provides another illustration of the stand pipe 518, which drains condensate accumulation above a threshold level.

Figure 6:
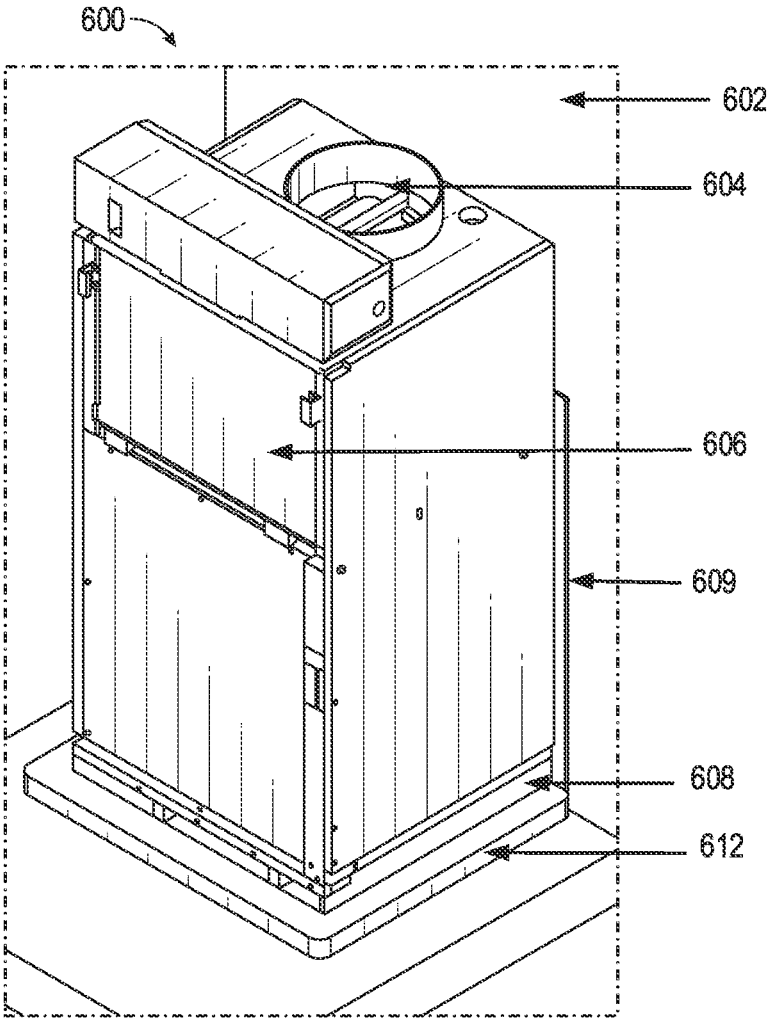
FIG. 6 illustrates another perspective view of the single package vertical unit of FIG. 1 in accordance with one or more embodiments of the present disclosure.

FIG. 6 illustrates another perspective view of a single package vertical unit 600 (which may be the same as, or similar to, the single package vertical unit 100 of FIG. 1 or any other single package vertical unit) in accordance with one or more embodiments of the present disclosure. Particularly, the figure illustrates an interior view (e.g., the interior of the building in which the unit is installed) of a single package vertical unit 600 installation. Any of the components illustrated in FIG. 6 may be the same as or similar to like components illustrated in FIG. 1 (or any other figure).

The single package vertical unit 600 may be installed on a building interior wall 602 and may have a plenum 609 that separates an outdoor heat exchanger section of the single package vertical unit 600 from the outdoor environment (not shown in the figure). The figure also shows an intake 606 to an indoor heat exchanger section of the single package vertical unit 600. Additionally, the figure shows the basepan 608 (which may include, for example, the outdoor coil tray 104 and/or the lower drain pan 108) and the drain platform 612 (which may be the same as drain platform 112 and/or any other drain platform described herein). Finally, the single package vertical unit 600 may include a discharge vent 604, which may be an opening in the single package vertical unit 600 through which any cooled or heated air is provided to be routed through the building.

Figure 7:
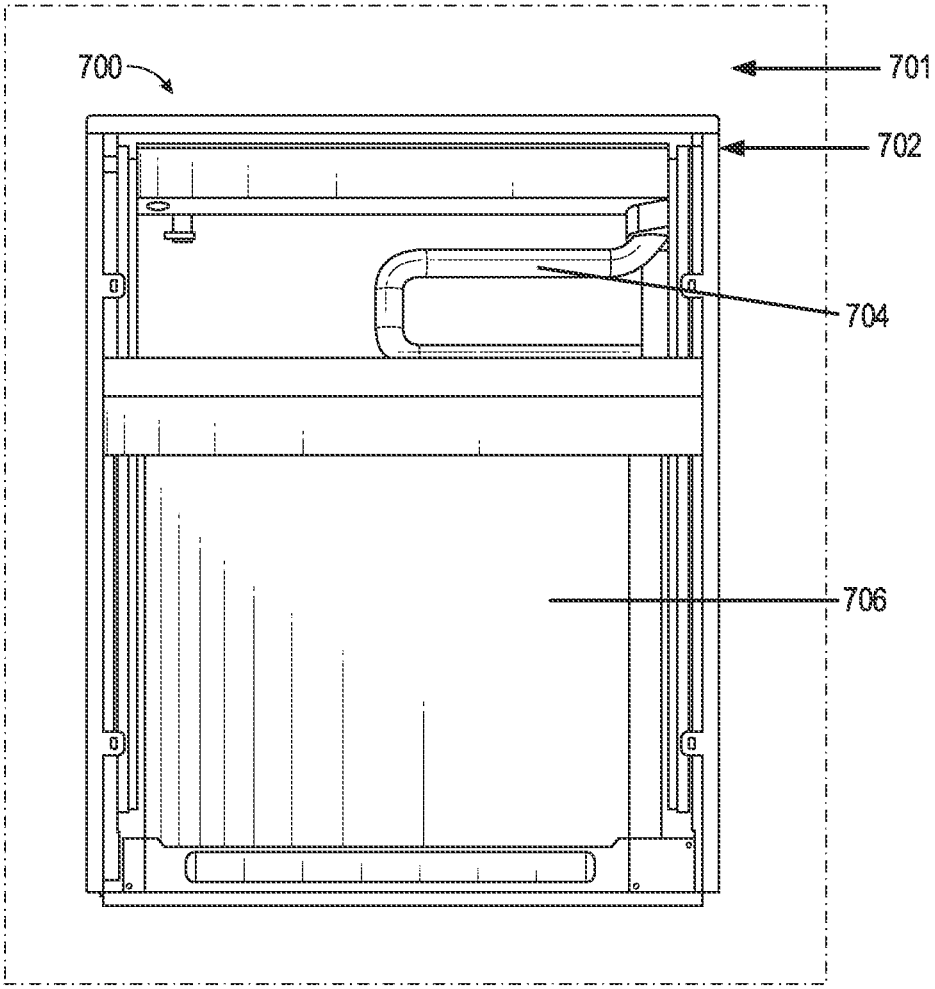
FIG. 7 illustrates another cross-sectional view of the single package vertical unit of FIG. 1 in accordance with one or more embodiments of the present disclosure.

FIG. 7 illustrates another cross-sectional view of a single package vertical unit 700 (which may be the same as, or similar to, the single package vertical unit 100 of FIG. 1 or any other single package vertical unit) in accordance with one or more embodiments of the present disclosure. Particularly, the figure illustrates an exterior view of a single package vertical unit 700 installation.

Shown in the figure are the building exterior 701 and a cross-section of some of the components of the single package vertical unit 700 as would be visible from the outdoor environment. For example, the cross-section shows the building exterior 701, a frame of the plenum 702, an intake 704 into the outdoor coil, and the outdoor coil 706.

Figure 8:
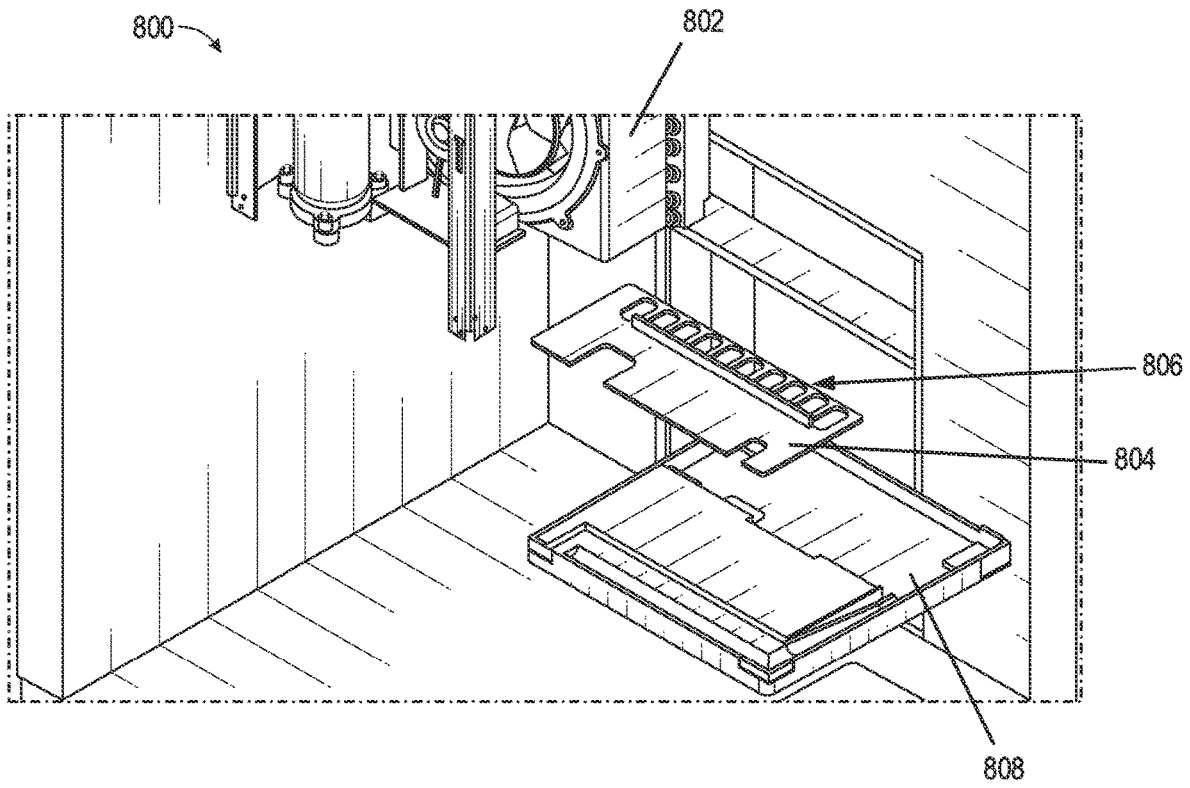
FIG. 8 illustrates an exploded perspective view of components included in the single package vertical unit of FIG. 1 in accordance with one or more embodiments of the present disclosure.

FIG. 8 illustrates an exploded perspective view of components included in a single package vertical unit 800 (which may be the same as, or similar to, the single package vertical unit 100 of FIG. 1 or any other single package vertical unit) in accordance with one or more embodiments of the present disclosure.

The exploded view shows the outdoor coil 802, the fan and slinger ring, and at least a portion of the lower drain pan 808 and the outdoor coil tray 804. Particularly, the figure further illustrates the perforated holes 806 that may be included on the outdoor coil tray 804 to allow condensate from the outdoor coil 802 to drain through the outdoor coil tray 804 and into the lower drain pan 808.

FIG. 9A illustrates another cross-sectional view of a single package vertical unit 900 (which may be the same as, or similar to, the single package vertical unit 100 of FIG. 1 or any other single package vertical unit) in accordance with one or more embodiments of the present disclosure. Particularly, the figure illustrates a more comprehensive view of the single package vertical unit 100 in that both the indoor heat exchanger section 902 and the outdoor heat exchanger section 904 are shown.

The indoor heat exchanger section 902 may include an indoor coil 903 and the outdoor heat exchanger section 904 may include an outdoor coil 906 (which may be the same as outdoor coil 102 and/or any other outdoor coil described herein). The single package vertical unit 900 may also include an outdoor fan 908 and a slinger ring (which may be the same as, or similar to, slinger ring 115 and/or any other slinger ring described herein).

Figure 9B:
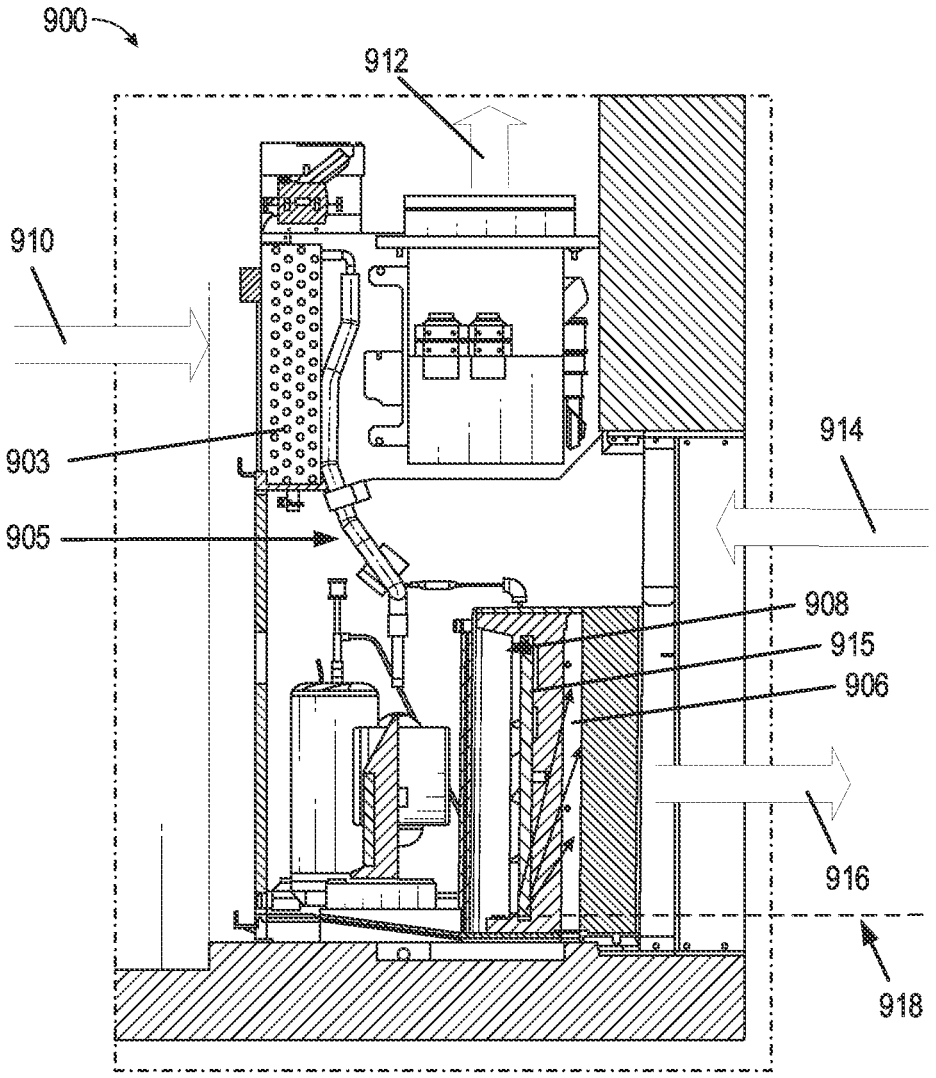
FIG. 9B illustrates another cross-sectional view of the single package vertical unit of FIG. 1 in a cooling mode in accordance with one or more embodiments of the present disclosure.

FIG. 9B illustrates another cross-sectional view of the single package vertical unit 900 in a cooling mode in accordance with one or more embodiments of the present disclosure.

In the cooling mode, the indoor coil 903 acts as the evaporator and produces condensate, while the outdoor coil 906 acts as the condenser. Cool indoor air (represented as arrow 910) is received through the indoor coil 903. The single package vertical unit 900 produces cool, dehumidified indoor air (represented as arrow 912) that is circulated within the building. The single package vertical unit 900 also receives low heat outdoor air (represented as arrow 914) and produces high heat outdoor air (represented as arrow 910 (represented as arrow 916), which is expelled to the outdoor environment. The indoor coil 903 produces condensate, which is drained down the drain hose 905 to the outdoor section of the single package vertical unit 900. This condensate is built up at the bottom of the outdoor section of the single package vertical unit 900, such that it is able to be "thrown" on the hot outdoor coil 906 by the slinger ring. For example, the water line 918 shows that the condensate may be accumulated to a level that may be reached by the slinger fan 915.

Figure 9C:
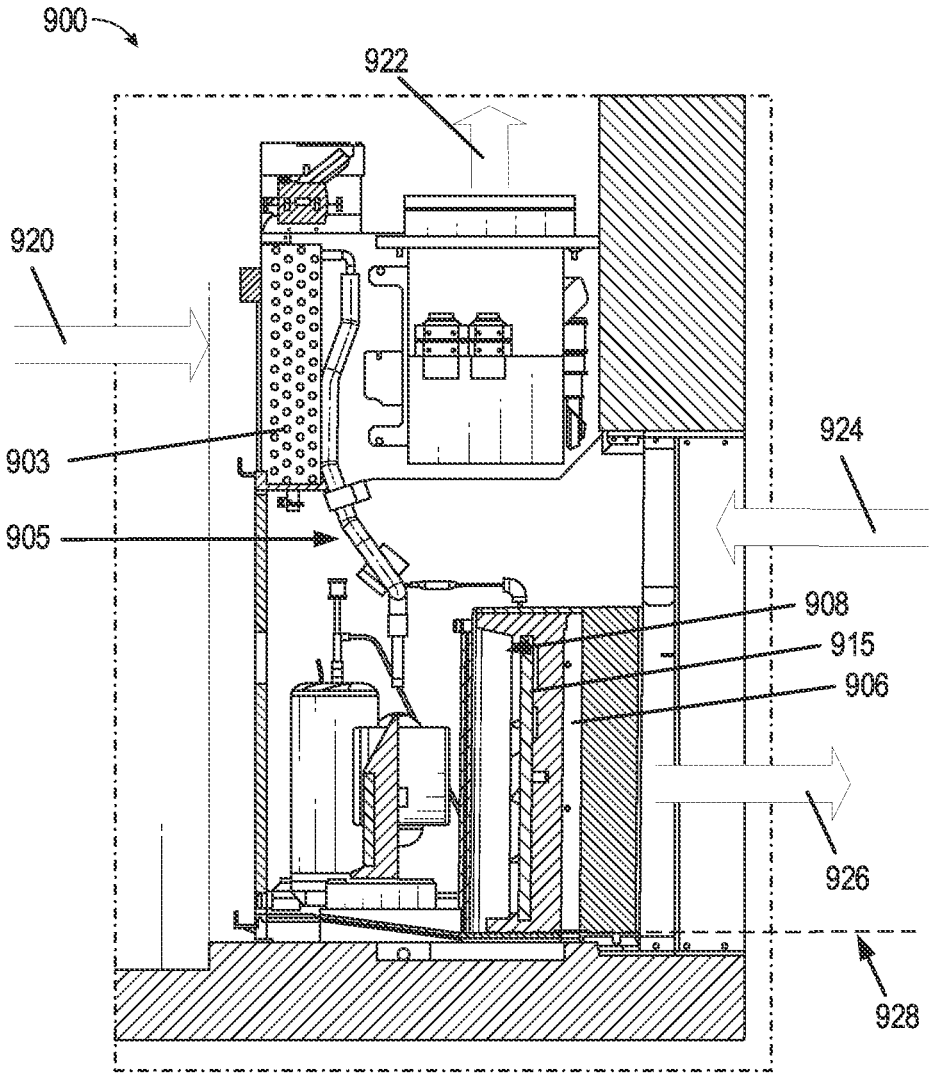
FIG. 9C illustrates another cross-sectional view of the single package vertical unit of FIG. 1 in a heating mode in accordance with one or more embodiments of the present disclosure.

FIG. 9C illustrates another cross-sectional view of the single package vertical unit 900 in a heating mode in accordance with one or more embodiments of the present disclosure. In the heating mode, the indoor coil 903 acts as the condenser and the outdoor coil 906 acts as the evaporator, so the outdoor coil 906 produces condensate instead of the indoor coil 903 in this mode.

In the heating mode, low heat indoor air (represented as arrow 920) is received through the indoor coil 903. The single package vertical unit 900 produces high heat indoor air (represented as arrow 922) that is circulated within the building. The single package vertical unit 900 also receives cool outdoor air (represented as arrow 924) and produces cool, dehumidified heat outdoor air (represented as arrow 926), which is expelled to the outdoor environment. The outdoor coil 906 in this mode produces condensate, which is drained from the single package vertical unit 900 through the basepan configuration including the outdoor heating coil tray and the lower drain pan as described herein. Thus, the water line 928 in the heating mode is lower than the water line 918 in the cooling mode. This water line 928 is low enough such that it remains below the slinger ring 915.

Figure 10:
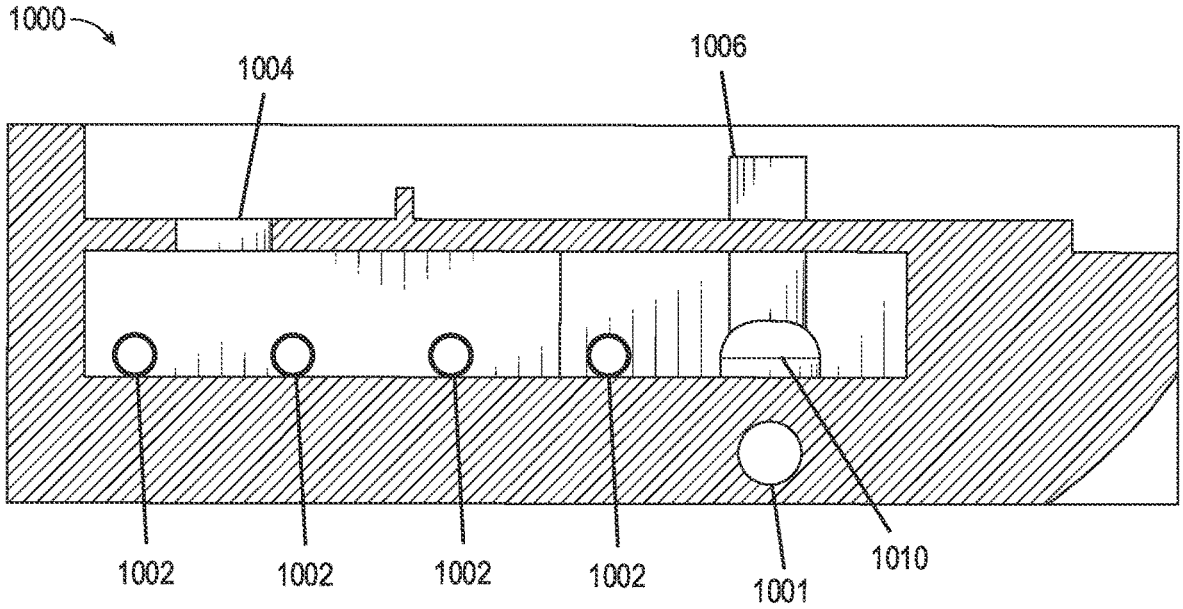
FIG. 10 illustrates another cross-sectional view of a basepan of a single package vertical unit in accordance with one or more embodiments of the present disclosure.

FIG. 10 illustrates another cross-sectional view of a basepan 1000 of a single package vertical unit in accordance with one or more embodiments of the present disclosure. The embodiment shown in FIG. 10 illustrates that a unit may include a consolidated basepan 1000 rather than requiring a separate basepan and platform. The basepan 1000 may include a perforated plate 1004 to allow condensate to enter into the basepan 1000. There may be a channel 1001 (which may be circular, for example) beneath the standpipe 1006 and the temperature-triggered drain valve 1010. This channel 1001 may include threads on either end to allow for plumbing connection directly to the basepan 1000. Also shown are one or more resistive heating elements 1002 that may be provided within the basepan 1000 (or any other basepan), as described herein.

Figure 11:
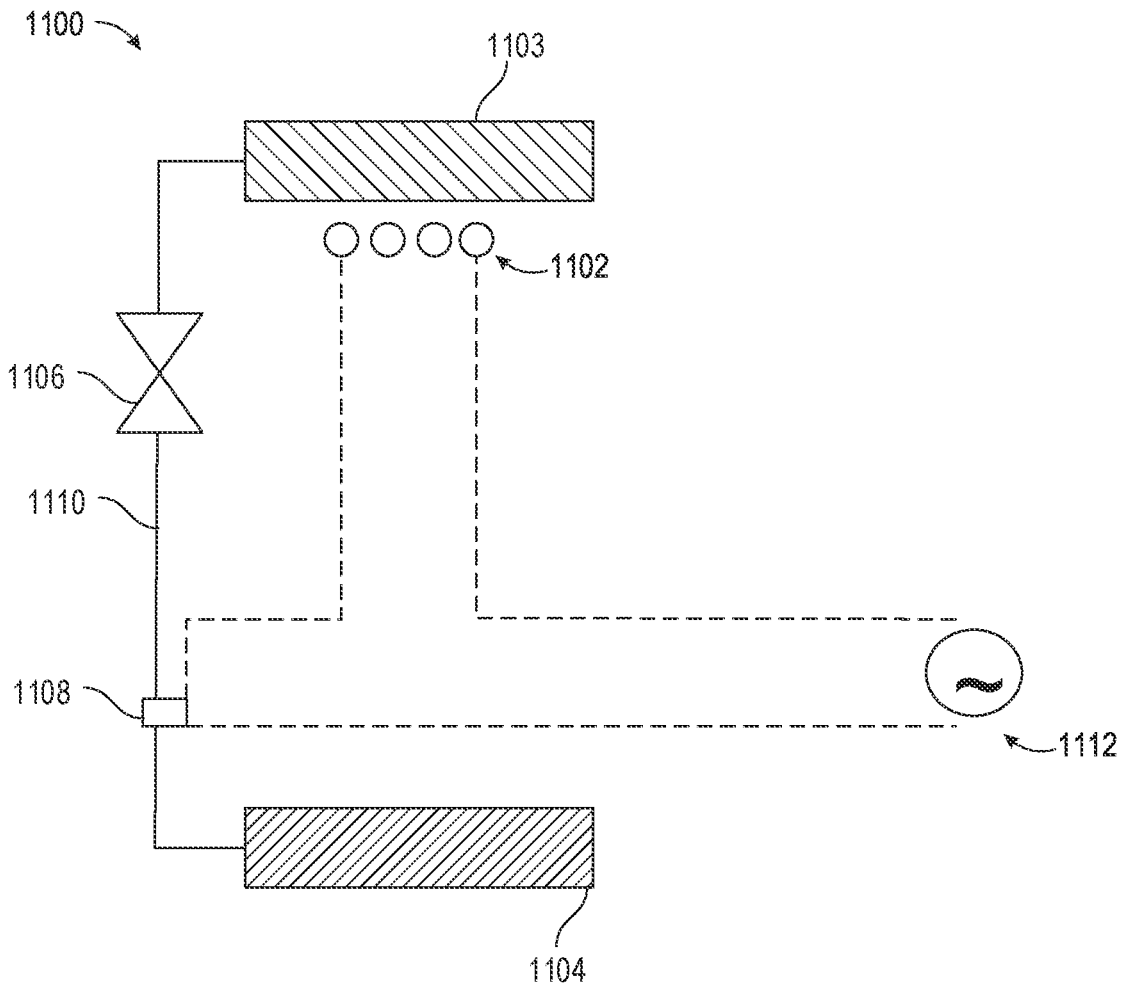
FIG. 11 illustrates a schematic of a system including resistive heating elements in accordance with one or more embodiments of the present disclosure.

FIG. 11 illustrates a schematic of a system 1100 including resistive heating elements 1102 in accordance with one or more embodiments of the present disclosure. The system 1100 illustrates a mechanism by which the resistive heating elements 1102 (which may be the same as, or similar to, resistive heating elements 1002 or any other resistive heating elements described herein or otherwise) may be selectively activated or deactivated to conserve power usage by the resistive heating elements 1002.

The system 1100 includes some of the components included within the single package vertical units described herein (for example, the outdoor coil 1103, indoor coil 1104, refrigerant expansion device 1106, etc.). The system 1100 also includes a thermal switch 1108 used to regulate the times at which the one or more resistive heating elements 1102 are activated or deactivated. The thermal switch 1108 is in contact with the heating liquid line 1110 such that thermal energy from the heating liquid line 1110 is received by the thermal switch 1108. The thermal switch 1108 is in electrical communication with the one or more resistive heating elements 1102 and a power source 1112. In this manner, when the thermal switch 1108 is closed, power may be supplied to the one or more resistive heating elements 1102 from the power source 1112. Similarly, power is not provided to the one or more resistive heating elements 1102 from the power source 1112 when the thermal switch 1108 is open.

In one or more embodiments, the thermal switch 1108 may close when the temperature of the heating liquid line 1110 falls below a threshold value (e.g., 25-35 degrees Fahrenheit or any other temperature). The thermal switch 1108 may open when the temperature of the heating liquid line 1110 then rises above a second threshold temperature value (e.g., 60 degrees Fahrenheit or any other temperature).

Accordingly, the one or more resistive heating elements 1102 may be temporarily used during defrost periods (and, in some cases, for a period of time directly after defrost to prevent defrost condensate from freezing). When a refrigeration defrost is initiated in a unit, the heating liquid line 1110 drops in temperature to the first temperature threshold, activating the one or more resistive heating elements 1102. The one or more resistive heating elements 1102 may remain activated during this defrost period as the heating liquid line 1110 remains cold. When defrost is terminated, that heating liquid line 1110 naturally increases in temperature until the temperature of the heating liquid line 1110 satisfies the second temperature threshold and the thermal switch 1108 opens.

It should be apparent that the foregoing relates only to certain embodiments of the present application and that numerous changes and modifications may be made herein by one of ordinary skill in the art without departing from the general spirit and scope of the disclosure.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A heat pump comprising:

an indoor coil;

an outdoor coil fan;

an outdoor coil;

an outdoor coil tray positioned below the outdoor coil, and positioned between the outdoor coil and the outdoor coil fan; and a lower drain pan positioned below the outdoor coil tray, the lower drain pan including a temperature-actuated drain valve, wherein the outdoor coil tray includes a stand pipe configured to drain condensate that accumulates when the condensate exceeds a threshold height in a cooling mode of the heat pump, and wherein the outdoor coil tray is configured to direct condensate produced by the outdoor coil to the lower drain pan, and wherein the outdoor coil tray is further configured to at least partially separate accumulated condensate from the outdoor coil fan in a heating mode of the heat pump by forming a physical barrier that prevents accumulated condensate in heating mode from entering a fan region.

2. The heat pump of claim 1, wherein the outdoor coil tray further comprises one or more perforated holes to allow the condensate to travel through the outdoor coil tray to the lower drain pan.

3. The heat pump of claim 2, wherein the outdoor coil tray further comprises a dividing wall, wherein the one or more perforated holes are positioned between the outdoor coil and the dividing wall.

4. The heat pump of claim 1, wherein the temperature-actuated drain valve is configured to-cover a drain hole of the lower drain pan in a first position and uncover the drain hole in a second position.

5. The heat pump of claim 4, wherein the temperature-actuated drain valve is configured to actuate to the first position when a temperature is less than or equal to a threshold temperature value, and wherein the temperature-actuated drain valve is configured to actuate to the second position when the temperature is greater than or equal to a threshold temperature value, wherein condensate is able to accumulate within the heat pump when the temperature-actuated drain valve is in the first position.

6. The heat pump of claim 1, wherein the lower drain pan further comprises one or more resistive heating elements configured to prevent the condensate from freezing when traveling to a drain hole.

7. The heat pump of claim 1, wherein the outdoor coil fan further comprises a slinger ring configured to transfer the condensate to the outdoor coil to cool the outdoor coil during a cooling mode of the heat pump.

8. The heat pump of claim 1, wherein the stand pipe is configured to drain condensate that accumulates from the lower drain pan, onto the outdoor coil tray, and to a threshold height above the outdoor coil tray in a cooling mode of the heat pump.

9. A condensate management system of a heat pump comprising:

an outdoor coil tray configured to be positioned below an outdoor coil of the heat pump, wherein the outdoor coil tray is configured to direct condensate produced by the outdoor coil from a first height to a lower drain pan positioned at a second height below the first height, wherein the lower drain pan includes a temperature-actuated drain valve, wherein the outdoor coil tray is further configured to at least partially separate accumulated condensate from an outdoor coil fan in a heating mode of the heat pump by including a dividing wall extending upward from the outdoor coil tray such that the dividing wall prevents accumulated condensate from reaching the outdoor coil fan, and wherein the temperature-actuated drain valve is configured to cover a drain hole of the lower drain pan in a first position and uncover the drain hole in a second position.

10. The condensate management system of claim 9, wherein the dividing wall is positioned between the outdoor coil and the outdoor coil fan.

11. The condensate management system of claim 9, wherein the temperature-actuated drain valve is configured to actuate to the first position when a temperature is less than or equal to a first threshold temperature value, and wherein the temperature-actuated drain valve is configured to actuate to the second position when the temperature is greater than or equal to a second threshold temperature value, wherein condensate is able to accumulate in the lower drain pan when the temperature-actuated drain valve is in the first position.

12. A system comprising:

a heat pump comprising:

an indoor coil;

an outdoor coil fan;

an outdoor coil;

an outdoor coil tray positioned below the outdoor coil; and a lower drain pan positioned below the outdoor coil tray, the lower drain pan including a temperature-actuated drain valve, wherein the outdoor coil tray is configured to direct condensate produced by the outdoor coil to the lower drain pan, and wherein the outdoor coil tray further comprises a dividing wall positioned between the outdoor coil and the outdoor coil fan and extending upward from the outdoor coil tray such that the dividing wall prevents condensate from accumulating and reaching the outdoor coil fan in a heating mode of the heat pump; and a drain platform positioned below the heat pump.

13. The system of claim 12, wherein the outdoor coil tray further comprises one or more perforated holes to allow the condensate to travel through the outdoor coil tray to the lower drain pan.

14. The system of claim 12, wherein the temperature-actuated drain valve is configured to cover a drain hole of the lower drain pan in a first position and uncover the drain hole in a second position.

15. The system of claim 14, wherein the temperature-actuated drain valve is configured to actuate to the first position when a temperature is less than or equal to a first threshold temperature value, and wherein the temperature-actuated drain valve is configured to actuate to the second position when the temperature is greater than or equal to a second threshold temperature value, wherein condensate is able to accumulate within the lower drain pan when the temperature-actuated drain valve is in the first position.

16. The system of claim 12, wherein the lower drain pan further comprises one or more resistive heating elements configured to prevent the condensate from freezing when traveling to a drain hole.

17. The system of claim 12, wherein the outdoor coil fan further comprises a slinger ring configured to transfer the condensate to the outdoor coil to cool the outdoor coil during a cooling mode of the heat pump.

18. The system of claim 12, wherein the lower drain pan is sloped towards a drain hole.

* * * * *